US005588888A

United States Patent [19]

Magharious

[11] Patent Number: 5,588,888

[45] Date of Patent: Dec. 31, 1996

[54] WET MARINE EXHAUST MUFFLER

[75] Inventor: Walaa Magharious, Thomasville, Ga.

[73] Assignee: Centek Industries, Inc., Thomasville, Ga.

[21] Appl. No.: 541,802

[22] Filed: Oct. 10, 1995

[51] Int. Cl.[6] ..... B63H 20/24; B63H 21/32

[52] U.S. Cl. ..... 440/89; 181/235; 181/238; 181/272

[58] Field of Search ..... 440/89; 181/235, 181/264, 269, 272, 238

[56] References Cited

U.S. PATENT DOCUMENTS

| | | | |
|---|---|---|---|
| 2,142,268 | 1/1939 | Gibbs, Jr. | 115/0.5 |
| 2,241,010 | 5/1941 | Chipley | 181/272 |
| 4,000,786 | 1/1977 | Ford | 181/52 |
| 4,019,456 | 4/1977 | Harbert | 115/73 |
| 4,713,029 | 12/1987 | Ford | 440/89 |
| 4,781,021 | 11/1988 | Winberg | 60/309 |
| 4,821,840 | 4/1989 | Harwood et al. | 181/238 |
| 5,046,977 | 9/1991 | Rodskier | 440/89 |
| 5,096,446 | 3/1992 | Tazaki et al. | 440/38 |
| 5,147,232 | 9/1992 | Miles, Jr. et al. | 440/89 |
| 5,196,655 | 3/1993 | Woods | 181/235 |
| 5,259,797 | 11/1993 | Miles, Jr. et al. | 440/89 |

*Primary Examiner*—Sherman Basinger
*Attorney, Agent, or Firm*—Biebel & French

[57] ABSTRACT

A wet marine exhaust muffler comprises a housing, an inlet pipe and an outlet pipe. The housing includes end walls each transverse with respect to an imaginary plane and converging side walls connecting converging edges of the end walls such that the converging side walls are symmetrical with respect to the imaginary plane. The inlet pipe extends through a first of the end walls, while the outlet pipe extends through a second of the end walls. Preferably, the converging side walls of the housing are so dimensioned as to conform to a converging lower hull portion of a boat to minimize the space occupied by the wet marine exhaust muffler. In an especially preferred form of the invention, at least one of the pipes in the wet marine exhaust muffler includes a notched upstream end portion and a cap positioned against the upstream end portion to define a radial opening to impart a swirling type vector to the flow as it enters the pipe.

12 Claims, 4 Drawing Sheets

WET MARINE EXHAUST MUFFLER

BACKGROUND OF THE INVENTION

1. Field of the Invention

The present invention pertains to exhaust mufflers for water craft, and more particularly to wet marine exhaust mufflers shaped to conform to the hulls of small motorized water craft.

2. Description of the Related Art

Motorized water craft typically include exhaust mufflers for muffling or attenuating exhaust noise generated by operation of the marine engine. Such mufflers must be capable of handling not only the exhaust gases themselves but also droplets of water injected into the exhaust gas stream from the cooling system of the engine. The water injected from the engine cooling system typically performs two functions, namely, absorbing engine exhaust noise and cooling the exhaust gases so that they might be safely discharged through the hull of the craft without presenting a fire hazard.

Mufflers of various designs have been placed in the exhaust conduit running between the engine and the discharge. Examples of marine exhaust systems include Miles et al., U.S. Pat. No. 5,259,797; Miles et al., U.S. Pat No. 5,147,232; Tazaki et al., U.S. Pat. No. 5,096,446; Winburg, U.S. Pat. No. 4,781,021; Harbert, U.S. Pat. No. 4,019,456 and U.S. Pat. No. 4,000,786 (Ford). Often, marine muffler designs are closely akin to the mufflers used on automobiles but are constructed of materials such as fiberglass which can better tolerate the marine environment.

The engine compartments of small boats tend to be cramped, and bulky marine mufflers do not readily fit within such small spaces. Additionally, many of the marine mufflers, such as that described in U.S. Pat. No. 4,000,786 (Ford) are roughly cylindrical in shape and do not fit easily in the tapering hull of a small boat. Accordingly, there remains a need in the art for a wet marine exhaust muffler with minimal space requirements. There is an even more specific need for such a muffler that functions via reactive and absorptive principles to effectively attenuate sound.

SUMMARY OF THE INVENTION

The above needs are addressed by means of a wet marine exhaust muffler comprising a housing, an inlet pipe or pipes and an outlet pipe or pipes. The housing includes end walls each transverse (that is, perpendicular or oblique) with respect to an imaginary vertical plane extending longitudinally through the housing and converging side walls connecting converging edges of the end walls such that the converging side walls are symmetrical with respect to the imaginary plane. The inlet pipe or pipes extend through a first of the end walls, while the outlet pipe or pipes extend through a second of the end walls. Preferably, the converging side walls of the housing are so dimensioned as to conform to a converging lower hull portion of a boat to minimize the space occupied by the wet marine exhaust muffler.

In an especially preferred form of the invention, the housing includes upper side walls adjacent to the converging side walls which connect parallel edges of the end walls. A relatively wide top wall extending between edges of the end walls and the upper side walls, and a relatively narrow bottom wall extending between edges of the end walls and the converging side walls, complete the housing. The preferred top wall includes an elongated channel parallel to the imaginary vertical plane to provide clearance for a steering cable of the boat. The preferred bottom wall includes a groove having an arcuate cross-section symmetrical about the imaginary plane to provide clearance for a drive shaft of the boat.

In addition, the preferred marine exhaust muffler includes an internal wall or baffle transverse to the imaginary plane dividing the interior of the housing into sequential first and second chambers referred to as an expansion and exhaust chamber and a baffle tube extending through the baffle for conducting an exhaust flow from the first chamber to the second chamber. The axis of the baffle tube is out of alignment with the axes of the inlet and outlet pipes to prevent direct flow of the exhaust gas through the housing, thereby disrupting sound waves generative of exhaust noise and atomizing the water droplets to increase their capacity to absorb acoustical energy. For similar reasons, the baffle tube and outlet pipes each preferably have a notched upstream end portion defining a radial opening in the tubular wall and a baffle cap positioned against the upstream end portion of each tube to impart a swirling action to the flow as it enters the pipe.

The invention will be further described in conjunction with the appended drawings and following detailed description.

DETAILED DESCRIPTION OF THE PREFERRED EMBODIMENT

Figure 1:
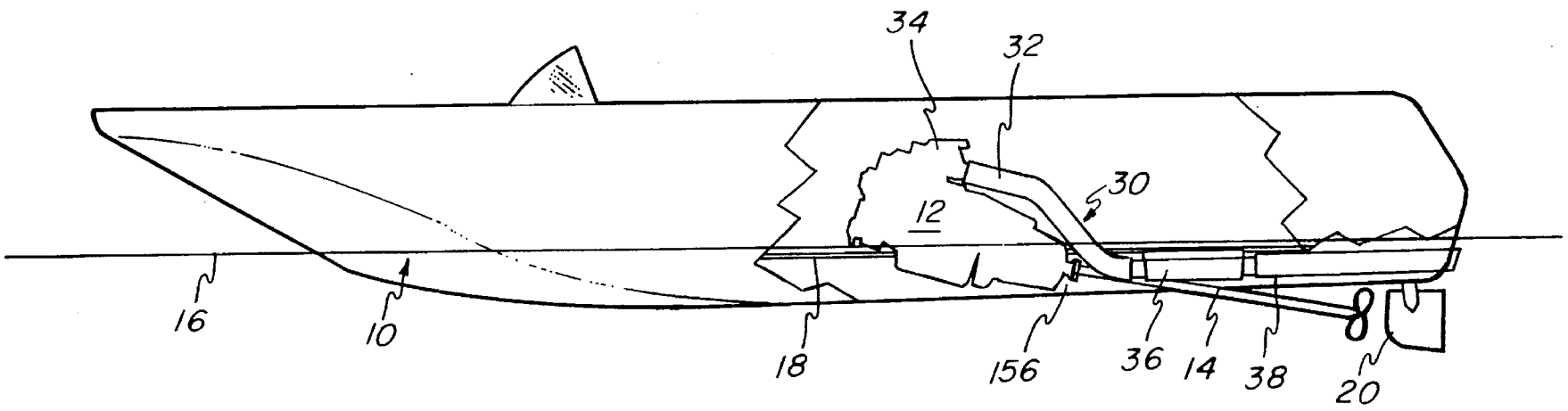
FIG. 1 is a schematic view of a boat mounting a marine wet exhaust system including a wet marine exhaust muffler according to the invention.

Referring initially to FIG. 1 of the drawings, a boat 10 includes an engine 12 for rotating a drive shaft 14 to propel the boat 10 along a water line 16. In addition, a steering cable 18 extends between a steering mechanism (not shown) and a rudder 20 for turning the boat 10 as the boat 10 moves along the water line 16. The boat 10 also includes a marine wet exhaust system 30 for treating and expelling exhaust gas generated by the engine 12. The marine wet exhaust system 30 includes a pair of exhaust conduits 32 (only one shown) for receiving exhaust gas from an engine, a pair of exhaust manifolds 34 (only one shown); a wet marine exhaust muffler 36 for attenuating exhaust noise; and an exhaust pipe 38 extending outside the boat 10 for expelling the exhaust gas and entrained water.

Figure 2:
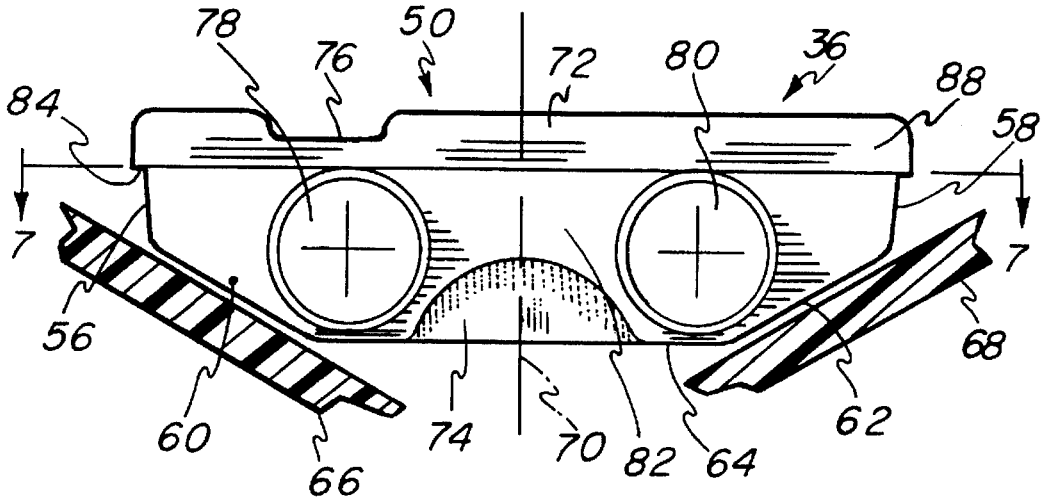
FIG. 2 is a front elevational view of the wet marine exhaust muffler of the invention.
Figure 3:
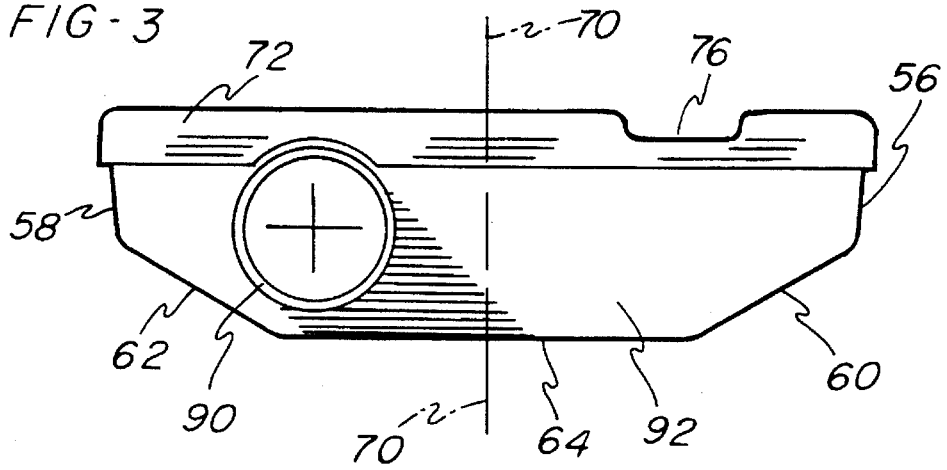
FIG. 3 is a rear elevational view of a version of the wet marine exhaust muffler having a single outlet as shown in FIG. 1.
Figure 4:
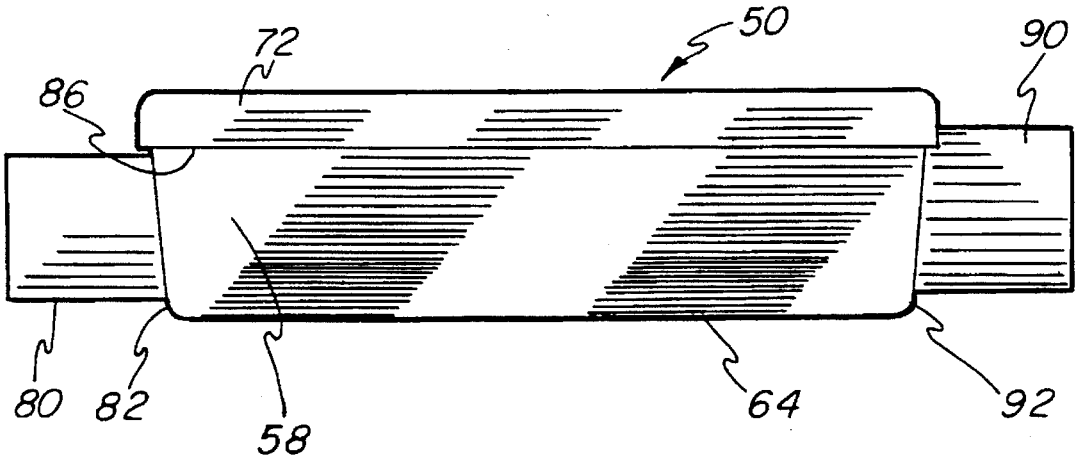
FIG. 4 is a side elevational view of the wet marine exhaust muffler of FIG. 1 with the opposite side view being a mirror image of this view.

Turning now to FIGS. 2, 3 and 4, the muffler 36 comprises a housing 50 having an upper surface 72 connected to bottom surface 64 through side wall members 56, 58. Each of the side wall members includes an inclined wall section 60, 62; each section 60, 62 converging or extending toward the other inclined wall section at bottom surface 64. The beveled slope of the inclined walls 60, 62 provides convenient nesting of the muffler between converging side members 66, 68 of the boat.

A vertically disposed imaginary plane 70 bisects the upper surface 72 and bottom surface 64 and extends longitudinally through the housing. An arcuately cross sectioned recess 74 is formed in the bottom surface so as to accommodate a drive shaft, such as a propeller shaft and the like therein as the muffler is positioned along the hull of the boat near the stern. Recess 74 extends lengthwise along a portion of the bottom surface 64 in the same direction as plane 70. Inclined wall sections 60, 62 are symmetrical with regard to this plane 70.

A notch or channel 76 is provided along the length of the upper surface for receipt of steering cables or the like therein.

Marine engine exhaust inlets 78, 80 are provided in the width wise extending front wall 82. The upper surface 72 of housing 50 is formed in the shape of a lid 88, welded or otherwise secured over the sidewalls 56, 58, providing extending flanges 84, 86.

FIG. 3 depicts a rear end view of the muffler. Here, exhaust tube 90 is provided through rear wall 92 of the housing so as to provide communication between the housing interior and surrounding environment.

In FIG. 4, housing 50 is shown comprising longitudinally extending sidewall 58, upper surface 72 and front and rear walls 82, 92 respectively.

Figure 5:
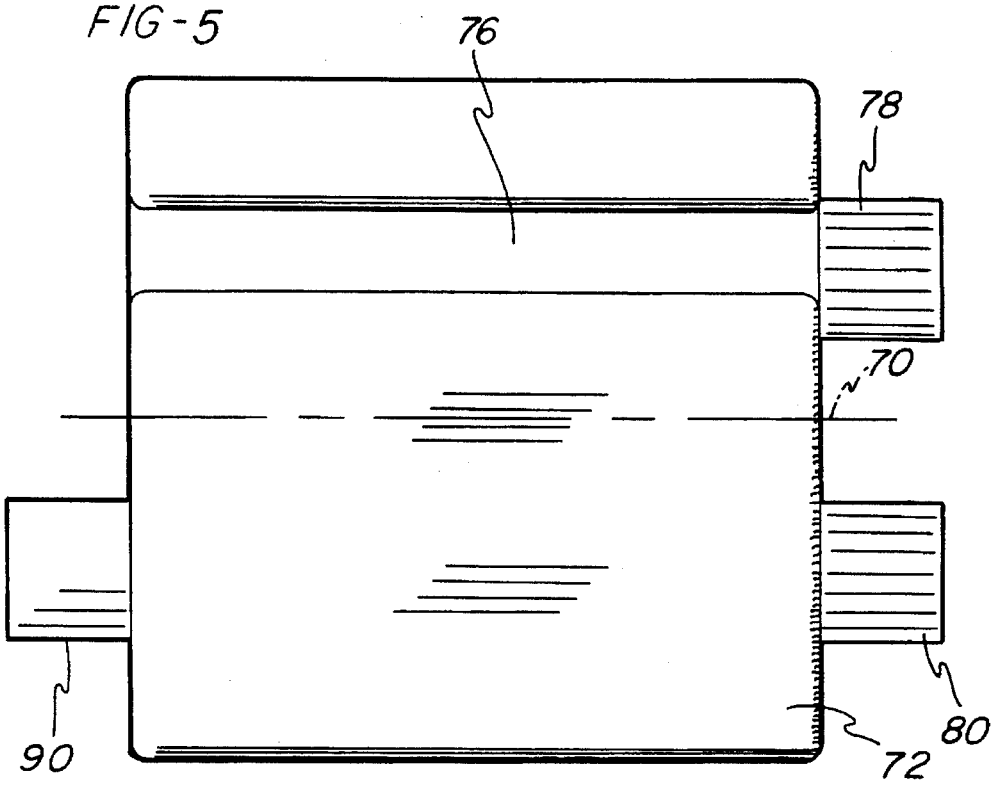
FIG. 5 is a top plan view of the wet marine exhaust muffler of FIG. 1.
Figure 6:
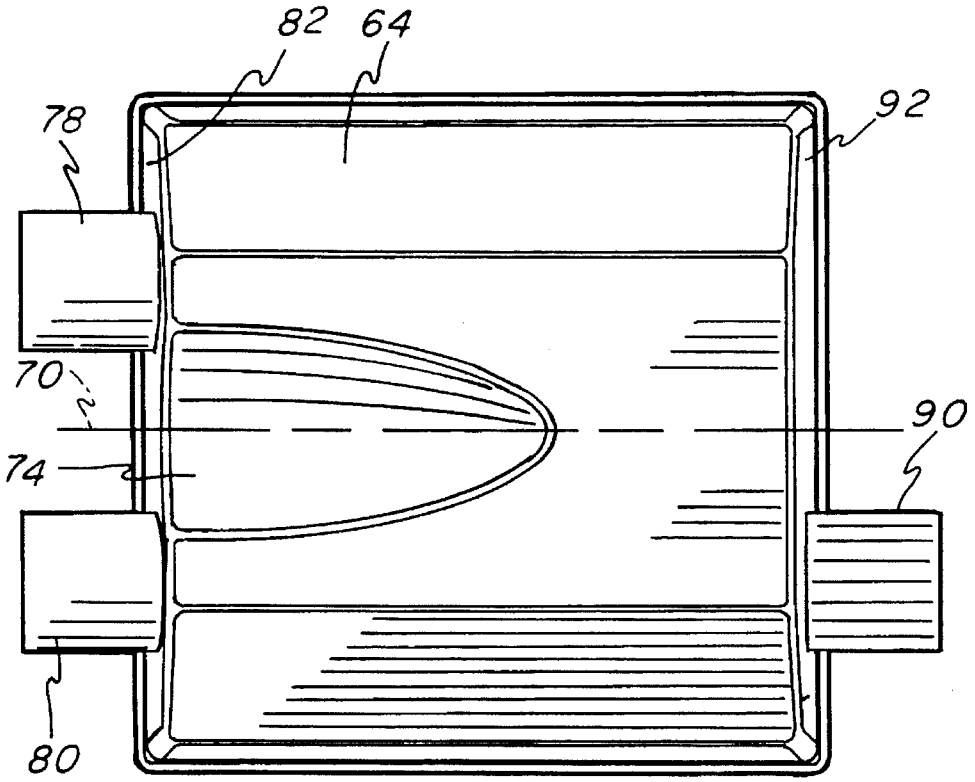
FIG. 6 is a bottom plan view of the wet marine exhaust muffler of FIG. 1.

FIG. 5 shows the top side of the muffler, with notch 76 formed in the upper surface and extending longitudinally along the top of the housing. In FIG. 6, the bottom surface 64 is shown with arcuately shaped recess 74 extending longitudinally along a portion of the housing length and having a substantially elliptical shape when viewed in plan.

Figure 7:
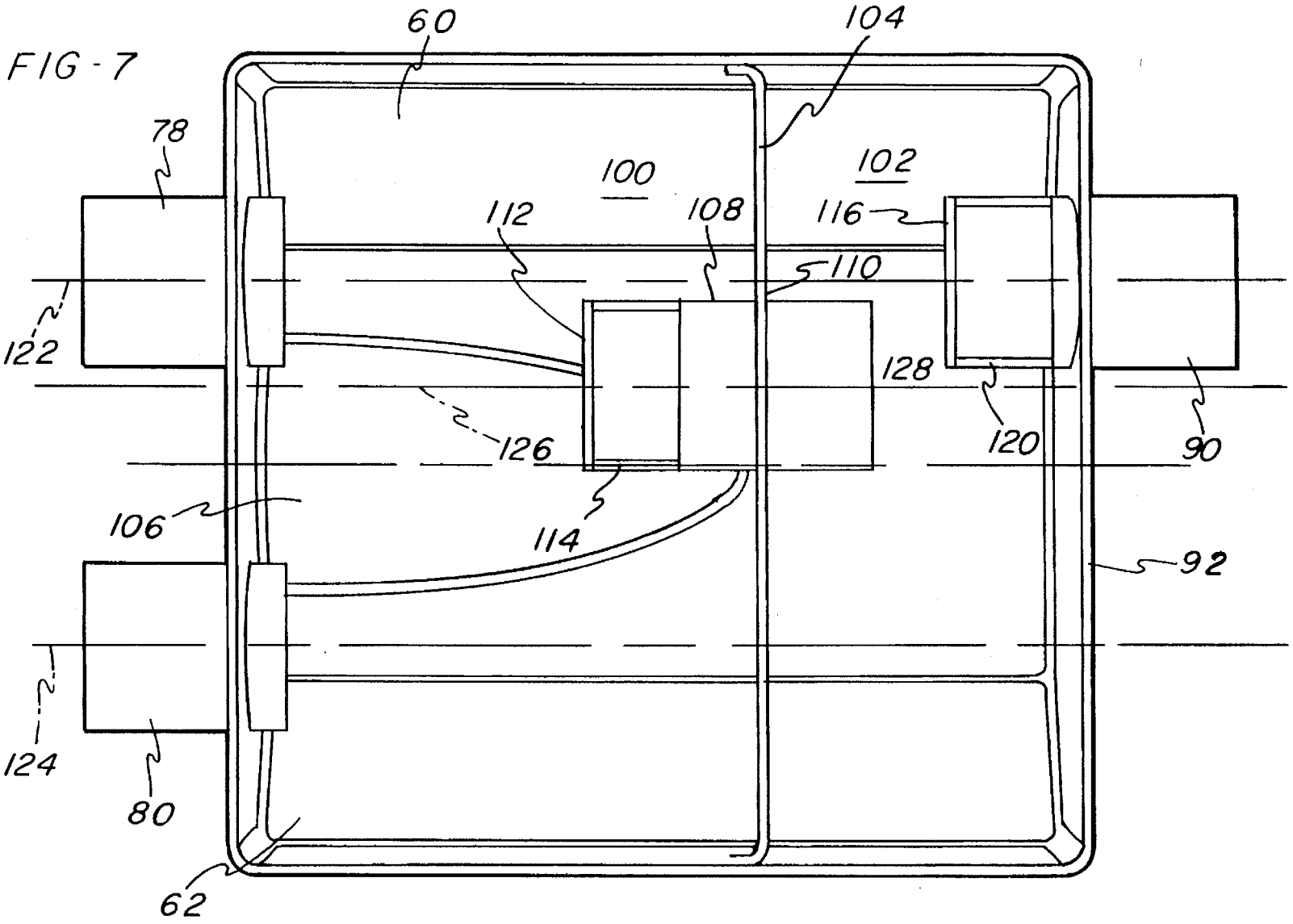
FIG. 7 is a top sectional view of the wet marine exhaust muffler taken along the lines and arrows 7—7 of FIG. 2.

FIG. 7 depicts the interior of the housing and shows that the housing is divided into sequential first and second chambers, hereafter expansion and exhaust chambers 100, 102, by the provision of transverse baffle 104 extending from sidewalls 56, 58.

Inlet tubes 78, 80 supply a mixture of hot exhaust gas and cooling liquid into the expansion chamber 100. The bottom surface of the chamber comprises a dome shaped convexity 106 (as formed by recess 74—see FIGS. 2 and 6) along the floor.

A baffle tube 108, extends through a bore 110 in the transverse baffle 104, providing communication between the expansion chamber 100 and exhaust chamber 102. Exhaust tube 90 extends through rear wall 92 and provides communication between exhaust chamber 102 and ambient. An extension exhaust pipe 38 (see FIG. 1) may be provided to direct exit of the exhaust gas/liquid mixture out of the boat, usually below the water line.

Inclined wall sections 60, 62 extend longitudinally along the floor of the housing, presenting sloped surfaces in contact with the exhaust mixture both in the expansion and exhaust chambers.

Baffle tube 108, at its upstream and thereof includes a baffle cap 112 in its upstream cylindrical end and, just downstream from cap, a radially disposed fluid inlet 114 is provided in the form of a cut out portion of the tube. Similarly, the exhaust tube 90 is also provided with a baffle cap 116 at its upstream cylindrical end thereof and a radial disposed fluid inlet is provided in the form of a cut out tube portion 120.

Central axes 122, 124 of inlet tubes 78, 80 are each laterally offset from the central axis 126 of baffle tube 108. Similarly, the axis 126 is laterally offset from axis 128 of the exhaust tube 90.

In operation, an exhaust flow comprising exhaust gases and entrained water enter the muffler through inlet pipes 78, 80. The pressure increases in the expansion chamber 100 due in part to the provision of cap baffle 112. The lateral offset of the axes 122, 124 from axis 126, and the housing contour presented by convexity 106 and sloped floor members formed by the inclined surfaces provide for entrapment: and atomization of the water in the exhaust fluid. Additionally, fluid velocity in chamber 100 increases as the fluid exits the chamber 100 into exhaust chamber 102 through the radial opening 114. The radial openings 114, 120 both impart a swirling type vector or flow path to the fluid.

Again, in chamber 102, pressure is increased due in part to the provision of cap baffle 116, with fluid velocity being accelerated as the exhaust gas and entrained vapor exit. Lateral offset of axis 126 and axis 128 ensure that fluid flow cannot take a straight path through chamber 102.

The muffler 34 provides for both reactive and absorptive sound attenuation in that: (1) plural chambers and connecting tubes are provided; and (2) directed flow of the fluid is provided by the laterally offset disposition of the inlet and baffle tube and baffle tube and exit tube so that water is atomized into small droplets which then act as an absorptive acoustical material.

The invention has been described with regard to a preferred apparatus embodiment, it is to be understood that the invention is not limited to this precise apparatus form, and that changes may be made therein without departing from the scope of the invention.

I claim:

1. A marine muffler for attenuating noise in a marine exhaust stream comprising exhaust gas and cooling water, said marine muffler comprising a housing, a baffle plate means positioned in said housing for dividing said housing into an upstream expansion chamber and a downstream exhaust chamber, inlet means in said expansion chamber for communicating with said marine exhaust stream, said baffle plate means comprising a bore formed therethrough, a baffle tube positioned in said bore and providing communication between said upstream expansion chamber and said downstream exhaust chamber, said baffle tube comprising a closed end portion extending into said expansion chamber and an open end portion disposed in said exhaust chamber, said baffle tube comprising swirl inlet means contiguous with said closed end of said baffle tube for imparting a swirling motion to said marine exhaust stream, said baffle tube swirl inlet means including a notched radially extending opening, said baffle tube further including an imperforate tubular wall extending from said swirl inlet means along said baffle tube to said open end portion, said exhaust chamber comprising exhaust tube means therein for exhausting said stream from said exhaust chamber to a surrounding atmosphere, said exhaust tube means including an upstream end thereof extending into said exhaust chamber and a downstream exit end, said upstream end thereof comprising a closed end portion and an exhaust tube inlet means contiguous with said closed end for imparting swirling motion to said exhaust stream as it is exhausted to said surrounding atmosphere.

2. Muffler as recited in claim 1 wherein said exhaust tube inlet means comprises a notched radially extending opening, said exhaust tube further comprising an imperforate tubular wall extending from said exhaust tube inlet means along said exhaust tube to said exit end.

3. Muffler as recited in claim 2 wherein said inlet means comprises a inlet tube having a central axis, said baffle tube having a central axis; said central axis of said inlet means being laterally offset from said baffle tube central axis.

4. Muffler as recited in claim 2 wherein said baffle tube has a central axis, said exhaust tube means having a central axis disposed in a laterally offset portion from said baffle tube central axis.

5. Muffler as recited in claim 2 wherein said inlet means comprises a first inlet tube and a second inlet tube, said first inlet tube having a central axis, said second inlet tube having a central axis laterally offset from said first inlet tube central axis; said baffle tube having a central axis that is laterally offset from said axes of said first and second inlet tubes.

6. Muffler as recited in claim 1 wherein said housing comprises an upper surface and a bottom surface, said upper surface and said bottom surface being connected by a pair of side wall members and a pair of end wall members, each said side wall member providing an inclined beveled angle relative to said bottom surface, said inlet means extending through a first end wall member of said pair of end wall members, and said exhaust tube means extending through a second end wall member of said pair of end wall members.

7. Muffler as recited in claim 6 wherein said housing comprises a vertical plane bisecting said upper surface and said bottom surface and extending longitudinally through said housing each said sidewall member converging toward said other sidewall member at said bottom surface, said sidewalls being symmetrically angled relative to said vertical plane.

8. Muffler as recited in claim 7 wherein said bottom surface comprises recess means formed between said sidewalls and extending in a direction parallel to said vertical plane.

9. Muffler as recited in claim 8 wherein said upper surface comprises a groove therein extending in a direction parallel to said vertical plane.

10. A marine muffler for attenuating noise in a marine exhaust stream including gas and cooling water components in a marine vessel having a hull, and a drive shaft, said marine muffler comprising a housing, baffle plate means positioned in said housing for dividing said housing into an upstream expansion chamber and a downstream exhaust chamber, inlet means in said expansion chamber for communicating with said marine exhaust stream, said housing including an upper surface, a bottom surface having an arcuately shaped recess extending therein for receiving a portion of said drive shaft therein; a pair of opposite end wall means and a pair of opposite side wall means, said opposite end wall means and said opposite side wall means connecting said upper surface and said bottom surface, said pair of opposite side wall means each including inclined wall sections which converge toward each other near said bottom surface and adapted for nesting in juxtaposition against said hull, said inlet means extending through a first end wall means of said pair of opposite end wall means, said baffle plate means comprising a bore formed therethrough, a baffle tube positioned in said bore and providing communication between said upstream expansion chamber and said downstream exhaust chamber, said baffle tube comprising a closed end portion extending into said expansion chamber and an open end portion disposed in said exhaust chamber, said baffle tube comprising swirl inlet means contiguous with said closed end for imparting a swirling motion to said marine exhaust stream, said exhaust chamber comprising exhaust tube means therein for exhausting said stream from said exhaust chamber to a surrounding atmosphere, said exhaust tube means extending through a second end wall means of said pair of opposite end wall means, said exhaust tube means including an upstream end thereof extending into said exhaust chamber and a downstream exit end, said upstream end thereof comprising a closed end portion and an exhaust tube inlet means contiguous with said closed end for imparting swirling motion to said exhaust stream as it is exhausted to said surrounding atmosphere through said downstream end.

11. Muffler as recited in claim 10 wherein said baffle tube swirl inlet means includes a notched radially extending opening, said baffle tube further including an imperforate tubular wall extending from said swirl inlet means along said baffle tube to said open end portion.

12. Muffler as recited in claim 10 wherein said exhaust tube inlet means comprises a notched radially extending opening, said exhaust tube further comprising an imperforate tubular wall extending from said exhaust tube inlet means along said exhaust tube to said downstream end.

* * * * *